US012304605B2

(12) United States Patent
Nickols et al.

(10) Patent No.: US 12,304,605 B2
(45) Date of Patent: May 20, 2025

(54) TRANSOM BRACKET ASSEMBLIES FOR SUPPORTING A MARINE DRIVE ON A VESSEL

(71) Applicant: Brunswick Corporation, Mettawa, IL (US)

(72) Inventors: Thomas F. Nickols, Fond du Lac, WI (US); Jeremy J. Kraus, Mt. Calvary, WI (US); David M. Schmidt, Omro, WI (US)

(73) Assignee: Brunswick Corporation, Mettawa, IL (US)

( * ) Notice: Subject to any disclaimer, the term of this patent is extended or adjusted under 35 U.S.C. 154(b) by 323 days.

(21) Appl. No.: 17/884,355

(22) Filed: Aug. 9, 2022

(65) Prior Publication Data

US 2024/0051650 A1 Feb. 15, 2024

(51) Int. Cl.
*B63H 20/12* (2006.01)
*B63H 20/02* (2006.01)

(52) U.S. Cl.
CPC ..... *B63H 20/02* (2013.01); *B63H 20/12* (2013.01)

(58) Field of Classification Search
CPC ..... B63H 20/02; B63H 20/06; B63H 20/12
See application file for complete search history.

(56) References Cited

U.S. PATENT DOCUMENTS

| | | | | |
|---|---|---|---|---|
| 1,451,452 | A | 4/1923 | Totten | |
| 2,549,481 | A | 4/1951 | Kiekhaefer | |
| 2,808,218 | A | 10/1957 | Steller | |
| 2,914,020 | A * | 11/1959 | Evert | B63H 20/12 114/144 R |
| 3,922,996 | A | 12/1975 | Meyer | |
| 3,961,595 | A | 6/1976 | Meyer | |
| 4,018,104 | A | 4/1977 | Bland et al. | |
| 4,521,201 | A | 6/1985 | Watanabe | |
| 4,701,141 | A | 10/1987 | Sumigawa | |
| 5,102,357 | A | 4/1992 | Bruesch et al. | |
| 5,180,319 | A | 1/1993 | Shiomo et al. | |

(Continued)

FOREIGN PATENT DOCUMENTS

| | | |
|---|---|---|
| CN | 206590092 | 10/2017 |
| EP | 1101696 | 5/2001 |

(Continued)

OTHER PUBLICATIONS

Evinrude, Evinrude E30DTSLAFD Tiller Arm Diagram, last accessed May 11, 2021, available at: https://www.boats.net/catalog/evinrude/outboard-by-year/af-models/e30dtslafd/tiller-arm.

(Continued)

*Primary Examiner* — Bradley Duckworth
(74) *Attorney, Agent, or Firm* — Andrus Intellectual Property Law, LLP

(57) ABSTRACT

A transom bracket assembly is for supporting a marine drive on a marine vessel. The assembly comprises a transom bracket comprising a swivel cylinder, a steering arm extending from the marine drive, a swivel tube having a first end coupled to the steering arm and a second end seated in the swivel cylinder so that steering of the steering arm relative to the transom bracket rotates the swivel tube in the swivel cylinder about a steering axis for the marine drive, and a yoke which couples the second end of the swivel tube to the marine drive.

18 Claims, 6 Drawing Sheets

(56) References Cited

U.S. PATENT DOCUMENTS

| | | | | |
|---|---|---|---|---|
| 5,340,342 | A | 8/1994 | Boda et al. | |
| 5,582,527 | A | 12/1996 | Nakamura | |
| 6,053,471 | A | 4/2000 | Brown | |
| 6,146,221 | A | 11/2000 | Natsume | |
| 6,174,211 | B1 | 1/2001 | Nakamura | |
| 6,283,806 | B1 | 9/2001 | Schmidt et al. | |
| 6,402,577 | B1 * | 6/2002 | Treinen | B63H 20/12 440/61 C |
| 6,659,817 | B1 | 12/2003 | Anderson et al. | |
| 6,902,450 | B2 | 6/2005 | Ohtsuki et al. | |
| 7,048,600 | B1 | 5/2006 | Broussard | |
| 7,090,551 | B1 | 8/2006 | Lokken et al. | |
| 7,244,152 | B1 | 7/2007 | Uppgard | |
| 7,297,035 | B2 | 11/2007 | Broussard | |
| 7,303,595 | B1 | 12/2007 | Janitz | |
| 7,311,571 | B1 * | 12/2007 | Swan | B63H 20/12 440/61 S |
| 7,314,396 | B2 | 1/2008 | Kubota et al. | |
| 7,410,397 | B2 | 2/2008 | Nakamuar et al. | |
| 7,681,513 | B1 | 3/2010 | Hundertmark | |
| 7,896,304 | B1 | 3/2011 | Eichinger et al. | |
| 8,069,803 | B1 | 12/2011 | Crawford | |
| 8,795,010 | B1 | 8/2014 | Wiatrowski | |
| 8,820,701 | B1 | 9/2014 | Eichinger | |
| 9,205,906 | B1 | 12/2015 | Eichinger | |
| 9,376,191 | B1 | 6/2016 | Jaszewski | |
| 9,463,859 | B1 | 10/2016 | Cooper, III et al. | |
| 9,481,434 | B1 | 11/2016 | Eichinger et al. | |
| 9,616,986 | B1 | 4/2017 | Gilk et al. | |
| 9,623,946 | B2 | 4/2017 | Delise | |
| 9,643,703 | B1 | 5/2017 | Eichinger | |
| 9,701,383 | B1 | 7/2017 | Stuber et al. | |
| 9,764,813 | B1 | 9/2017 | Zarembka et al. | |
| 9,776,699 | B1 * | 10/2017 | Alby | B63H 20/12 |
| 9,783,278 | B1 | 10/2017 | Dannenberg et al. | |
| 9,789,945 | B1 | 10/2017 | Vaninetti et al. | |
| 9,963,213 | B1 | 5/2018 | Jaszewski et al. | |
| 9,969,475 | B1 | 5/2018 | Waisanen | |
| 10,005,536 | B2 | 6/2018 | Fukuchi et al. | |
| 10,124,871 | B1 | 11/2018 | Eichinger et al. | |
| 10,246,173 | B1 | 4/2019 | Ingebritson | |
| 10,464,648 | B1 | 11/2019 | Amerling et al. | |
| 10,696,367 | B1 | 6/2020 | Ingebritson et al. | |
| 10,787,236 | B1 | 9/2020 | Erickson et al. | |
| 11,066,140 | B1 | 7/2021 | Huffer et al. | |
| 11,097,824 | B1 | 8/2021 | Anderson, Jr. | |
| 11,866,137 | B1 | 1/2024 | Jaszewski | |
| 2009/0001244 | A1 | 1/2009 | Lucier et al. | |
| 2009/0170384 | A1 | 7/2009 | Balogh et al. | |
| 2011/0065340 | A1 | 3/2011 | Klawitter et al. | |
| 2013/0316603 | A1 | 11/2013 | Hagi | |
| 2019/0344873 | A1 | 11/2019 | Kimpara | |
| 2021/0394882 | A1 | 12/2021 | Waldvogel | |
| 2023/0102741 | A1 * | 3/2023 | Fergus | B63H 20/06 440/53 |
| 2023/0192260 | A1 | 6/2023 | Dannenberg et al. | |
| 2023/0257095 | A1 | 8/2023 | Waldvogel | |
| 2024/0051650 | A1 | 2/2024 | Nickols | |

FOREIGN PATENT DOCUMENTS

| | | |
|---|---|---|
| EP | 4155191 | 3/2003 |
| JP | S5654697 | 5/1981 |
| JP | S6479000 | 3/1989 |
| JP | 3976290 | 9/2007 |
| WO | 2022045986 | 3/2022 |

OTHER PUBLICATIONS

Evinrude, Evinrude E-Tec 25 HP, last accessed May 11, 2021, available at: https://www.evinrude.com/en-US/e-tec/etec-full-specs.html#tab=12.

Honda Marine, Honda BF25-30hp Outboard Engines, last accessed May 11, 2021, available at: https://marine.honda.com/outboards/motor-detail/BF25-30#specs.

Honda Marine, Honda Marine BF25DK3 SHGA S/N: BATJ-1501086 Parts List, last accessed Dec. 4, 2018, availableat: http://peparts.honda.com/marine#/serial.

Honda Motor Co., Ltd., BF25D-BF30D Owner's Manual, 2017.

Mercury Marine, 2010 Mercury Marine 25/30 EFI FourStroke Owner's Manual.

Mercury Marine, 2015 Mercury Marine 15/20 FourStroke Outboard Installation Operation Maintenance WarrantyManual.

PPF Mud Motors, "PPF Wood Duck 6.5 HP Mud Motor," screenshot from photo gallery, admitted prior art, last accessed Jul. 5, 2021, available at https://ppfmudmotors.com/gallery/#swipebox.

PPF Mud Motors, "Quick Drop Transom Mount," website, available at least as early as Sep. 15, 2017, lastaccessed Jul. 5, 2021, available at http://ppfmudmotors.com/quick-drop-transom-mount/—this is the webpagescreenshot.

Remigo, E-Outboard, webpage and 5 photographs, Sep. 26, 2020, available at https://web.archive.org/web/20200926115717/https://remigo.eu/.

Suzuki Motor Corporation, DF25A-DF30A Owner's Manual, Oct. 2015.

Suzuki Motor Corporation, Suzuki DF 30A Parts Listings—2018, last accessed Dec. 4, 2018, available at: https://www.brownspoint.com/store/pc/BP_AP_AssemblyDetail.asp?ID=19761.

Unpublished U.S. Appl. No. 17/852,944.

Yamaha Motor Co., Ltd., 2013 Yamaha Outboard 30hp—F30LA Steering Friction Section, last accessed Dec. 4, 2018, available at: https://www.crowleymarine.com/yp/KE329296/steering-friction-f30la-2013-30hp.

Yamaha Motor Co., Ltd., 2013 Yamaha Outboard 30hp—F30LA, Bracket 1 Section, last accessed Dec. 4, 2018, available at: crowleymarine.com.

Yamaha Motor Co., Ltd., Yamaha F25 T25 Owner's Manual, May 2013.

Yamaha Motor Co., Ltd., Yamaha F25SMHC—2006 and Later, Parts List, last accessed Dec. 4, 2018, available at: https://shop.yamahaonlineparts.com/OEMpartfinder.htm.

Yamaha Motor Co., Ltd., Yamaha 30hp Co-Pilot Manual, Feb. 2010.

Declaration of Prior Art submitted in U.S. Appl. No. 17/852,944.

Unpublished U.S. Appl. No. 17/487,116.

Unpublished U.S. Appl. No. 17/509,739.

Unpublished U.S. Appl. No. 17/509,739, "Integrated Copilot and Locking Mechanism for Marine Drives".

Unpublished U.S. Appl. No. 17/852,944, "Copilot Devices and Apparatuses for Supporting Marine Drives Having a Copilot Device".

Office Action issued in U.S. Appl. No. 17/487,116, dated Nov. 8, 2024.

* cited by examiner

TRANSOM BRACKET ASSEMBLIES FOR SUPPORTING A MARINE DRIVE ON A VESSEL

FIELD

The present disclosure relates to assemblies for supporting marine drives with respect to a vessel.

BACKGROUND

The following are incorporated herein by reference, in entirety.

U.S. Pat. No. 9,205,906 discloses a mounting arrangement for supporting an outboard motor with respect to a marine vessel extending in a fore-aft plane. The mounting arrangement comprises first and second mounts which each have an outer shell, an inner wedge concentrically disposed in the outer shell, and an elastomeric spacer between the outer shell and the inner wedge. Each of the first and second mounts extend along an axial direction, along a vertical direction that is perpendicular to the axial direction, and along a horizontal direction which is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different, second angle to the horizontal and vertical directions. A method is for making the mounting arrangement.

U.S. Pat. No. 9,701,383 discloses a marine propulsion support system having a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolation mounts connect the first and second cradle arms to the drive unit, respectively. An upper motion-limiting bump stop is located remotely from the vibration isolation mounts and between the swivel bracket and the drive unit.

U.S. Pat. No. 9,764,813 discloses a tiller for an outboard motor. The tiller comprises a tiller body which is elongated along a tiller axis between a fixed end and a free end. A throttle grip is disposed on the free end. The throttle grip is rotatable through a first (left-hand) range of motion from an idle position in which the outboard motor is controlled at idle speed to first (left-hand) wide open throttle position in which the outboard motor is controlled at wide open throttle speed and alternately through a second (right-hand) range of motion from the idle position to a second (right-hand) wide open throttle position in which the outboard motor is controlled at wide open throttle speed.

U.S. Pat. No. 11,097,824 discloses an apparatus for steering an outboard motor with respect to a marine vessel. The apparatus includes a transom bracket configured to support the outboard motor with respect to the marine vessel; a tiller for manually steering the outboard motor with respect to a steering axis; a steering arm extending above the transom bracket and coupling the tiller to the outboard motor so that rotation of the tiller causes rotation of the outboard motor with respect to the steering axis, wherein the steering arm is located above the transom bracket; and a copilot device configured to lock the outboard motor in each of a plurality of steering positions relative to the steering axis. The copilot device extends above and is manually operable from above the steering arm.

U.S. patent application Ser. No. 17/487,116 discloses an outboard motor including a transom clamp bracket configured to be supported on a transom of a marine vessel and a swivel bracket configured to be supported by the transom clamp bracket. A propulsion unit is supported by the swivel bracket, the propulsion unit comprising a head unit, a midsection below the head unit, and a lower unit below the midsection. The head unit, midsection, and lower unit are generally vertically aligned with one another when the outboard motor is in a neutral tilt/trim position. The propulsion unit is detachable from the transom clamp bracket.

U.S. patent application Ser. No. 17/509,739 discloses an apparatus for removably supporting a marine drive on a marine vessel. The apparatus has a transom bracket assembly for mounting to the marine vessel, a steering bracket for coupling the marine drive to the transom bracket assembly so the marine drive is steerable relative to the transom bracket assembly and the marine vessel; and an integrated copilot and locking mechanism configured to retain the steering bracket in a plurality of steering orientations. The mechanism is further configured to lock and alternately unlock the steering bracket relative to the transom bracket assembly so that in a locked position the marine drive is retained on the transom bracket assembly and so that in an unlocked position the marine drive is removable from the transom bracket assembly.

U.S. patent application Ser. No. 17/852,944 discloses an apparatus for supporting a marine drive on a marine vessel. The apparatus has a transom bracket comprising a swivel cylinder and a steering bracket configured to couple the marine drive to the transom bracket, the steering bracket comprising a steering arm and a swivel tube seated in the swivel cylinder, wherein steering of the steering arm relative to the transom bracket rotates the swivel tube in the swivel cylinder and thereby steers the marine drive. A copilot device is configured to frictionally restrain rotation of the swivel tube in the swivel cylinder by applying diametrically opposing pushing and pulling forces on the swivel tube.

SUMMARY

This Summary is provided to introduce a selection of concepts which are further described herein below in the Detailed Description. This Summary is not intended to identify key or essential features of the claimed subject matter, nor is it intended to be used as an aid in limiting scope of the claimed subject matter.

In non-limiting examples disclosed herein, a transom bracket assembly is for supporting a marine drive on a vessel. The transom bracket assembly comprises a transom bracket having a swivel cylinder, a steering arm extending from the marine drive, a swivel tube having a first end coupled to the steering arm and a second end seated in the swivel cylinder so that steering of the steering arm relative to the transom bracket rotates the swivel tube in the swivel cylinder about a steering axis for the marine drive, and a yoke which couples the second end of the swivel tube to the marine drive.

In non-limiting examples, the swivel tube is coupled to the steering arm at a first joint which provides a first shear location at which the marine drive will separate from the swivel cylinder upon an impact load on the marine drive. The yoke is coupled to the marine drive at a second joint which provides a second shear location at which the marine drive will separate from the swivel cylinder upon the impact load on the marine drive. In certain examples, the first joint comprises a bolted connection and the second joint comprises a male-female connection device such as a pin and an aperture which are configured so that insertion of the swivel tube into the swivel cylinder operably couples the swivel tube to the marine drive.

In non-limiting examples, the steering arm is located above the swivel cylinder and the yoke is located below the steering arm. The yoke comprises a receiver in the swivel cylinder and a yoke arm extending from the receiver, the receiver being configured to operably engage with the swivel tube when the swivel tube is inserted in the swivel cylinder so that the receiver and yoke arm rotate with the swivel tube relative to the steering axis. In certain examples, the receiver comprises a yoke cylinder, and the swivel tube is nested in the yoke cylinder, and further the swivel tube and yoke cylinder are keyed together so that the swivel tube and yoke cylinder rotate together about the steering axis.

BRIEF DESCRIPTION OF THE DRAWINGS

Examples are described with reference to the following drawing Figures. The same numbers are used throughout to reference like features and components.

DETAILED DESCRIPTION

Figure 1:
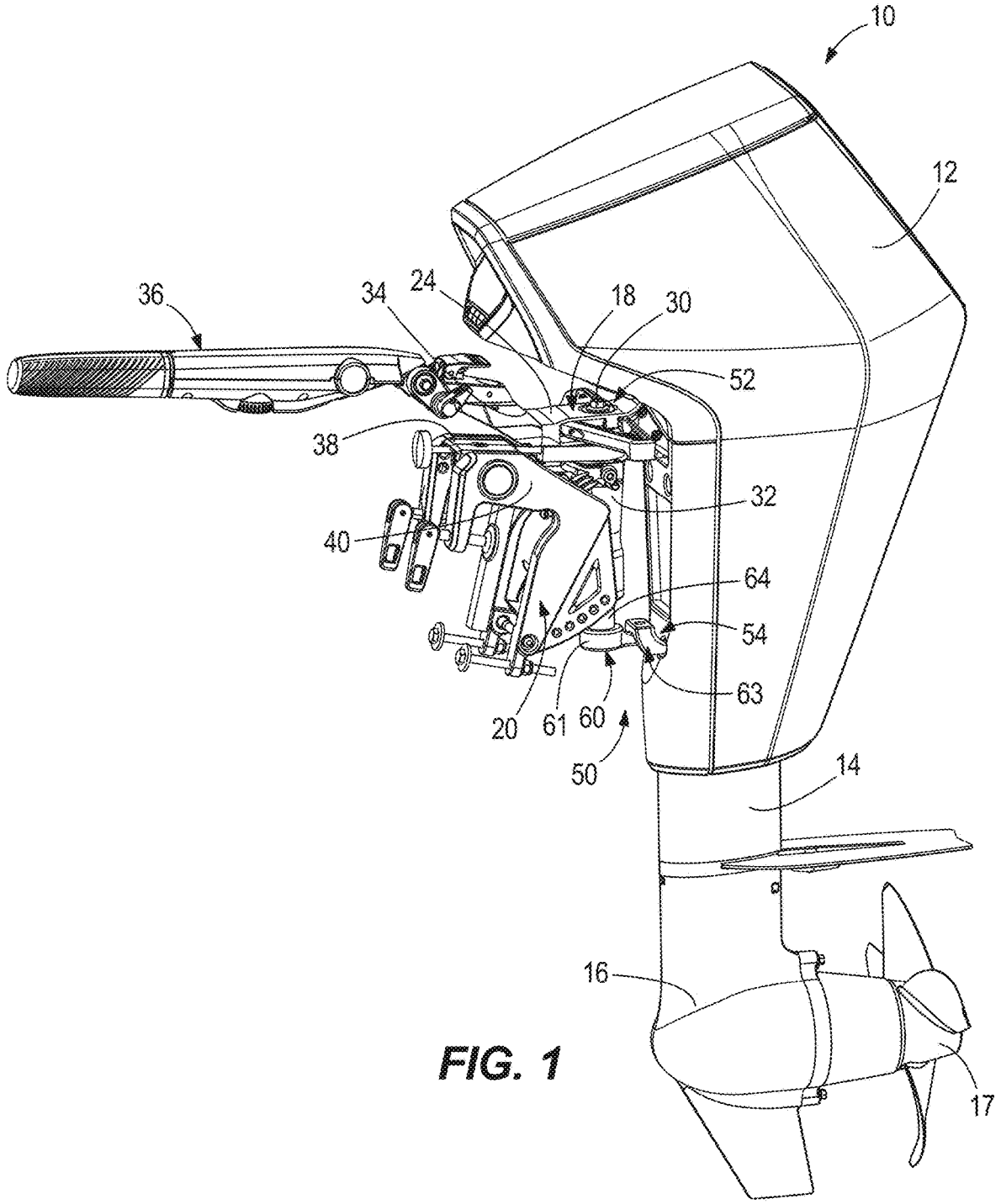
FIG. 1 is a perspective view of a transom bracket assembly for supporting a marine drive with respect to a marine vessel.
Figure 2:
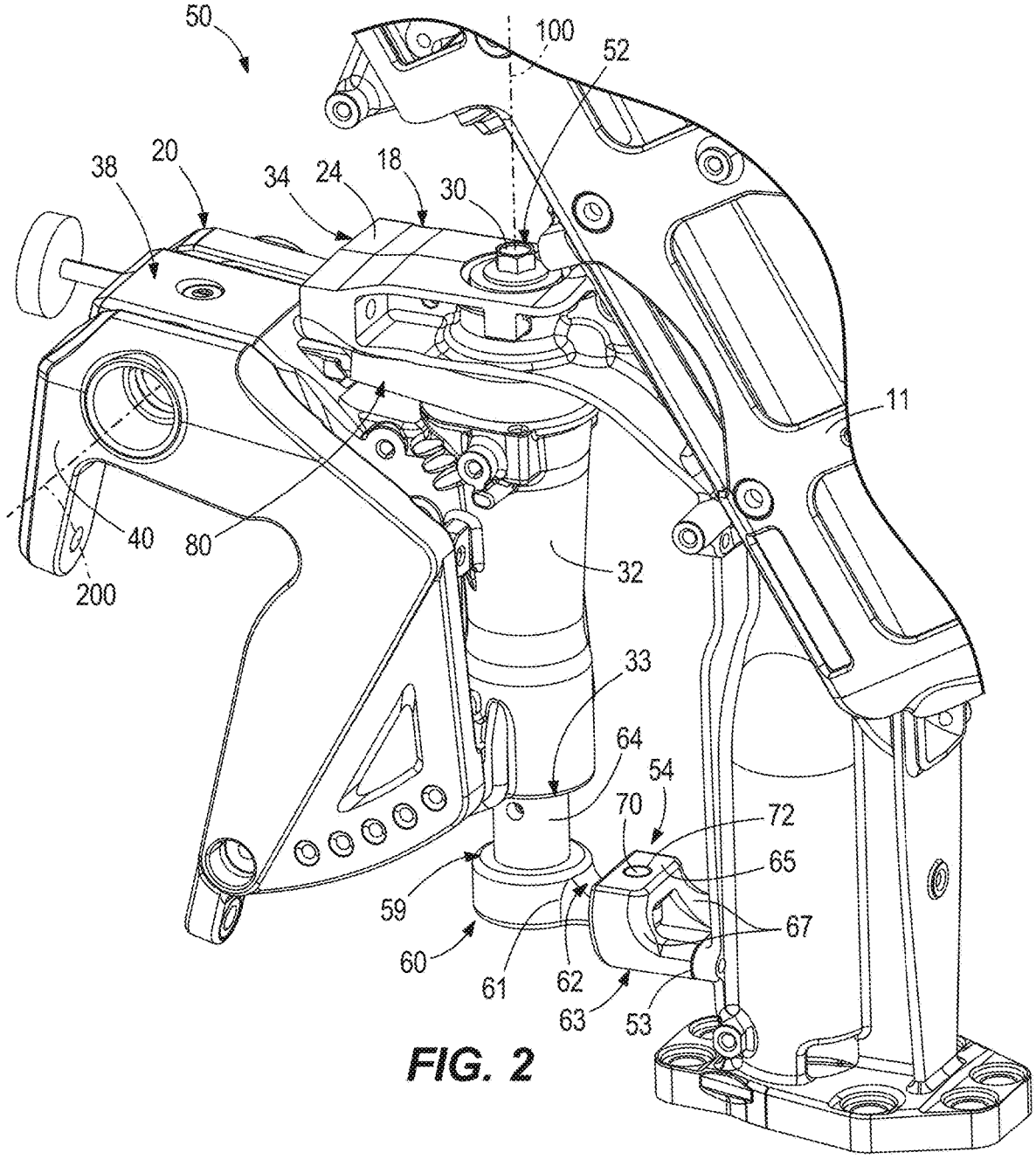
FIG. 2 is a perspective view of the assembly.

FIGS. 1 and 2 show a marine drive, which in the illustrated example is an outboard motor 10. The outboard motor 10 has a supporting frame 11, a cowling 12 on the supporting frame 11, an extension leg 14 which is coupled to and extends downwardly from a lower end portion of the supporting frame 11, and a torpedo housing 16 which is coupled to the lower end portion of the extension leg 14. The torpedo housing 16 supports a propulsor 17 for generating a thrust force in the water for propelling the marine vessel. In the illustrated example, the propulsor 17 includes a propeller which is rotated by an electric motor contained within the torpedo housing 16. Rotation of the propeller generates the thrust force. The configuration of the propulsor 17 can vary from what is shown, and in other examples includes more than one propeller, one or more impellers, and/or the like. The orientation of the propulsor 17 can also vary from what is shown, and in other examples includes a forwardly-facing or tractor-type propulsor. The type of marine drive can also vary from what is shown, and in other examples includes an outboard motor having an internal combustion engine, and/or any other known means for generating a thrust force in water for propelling the marine vessel in water.

Figure 3:
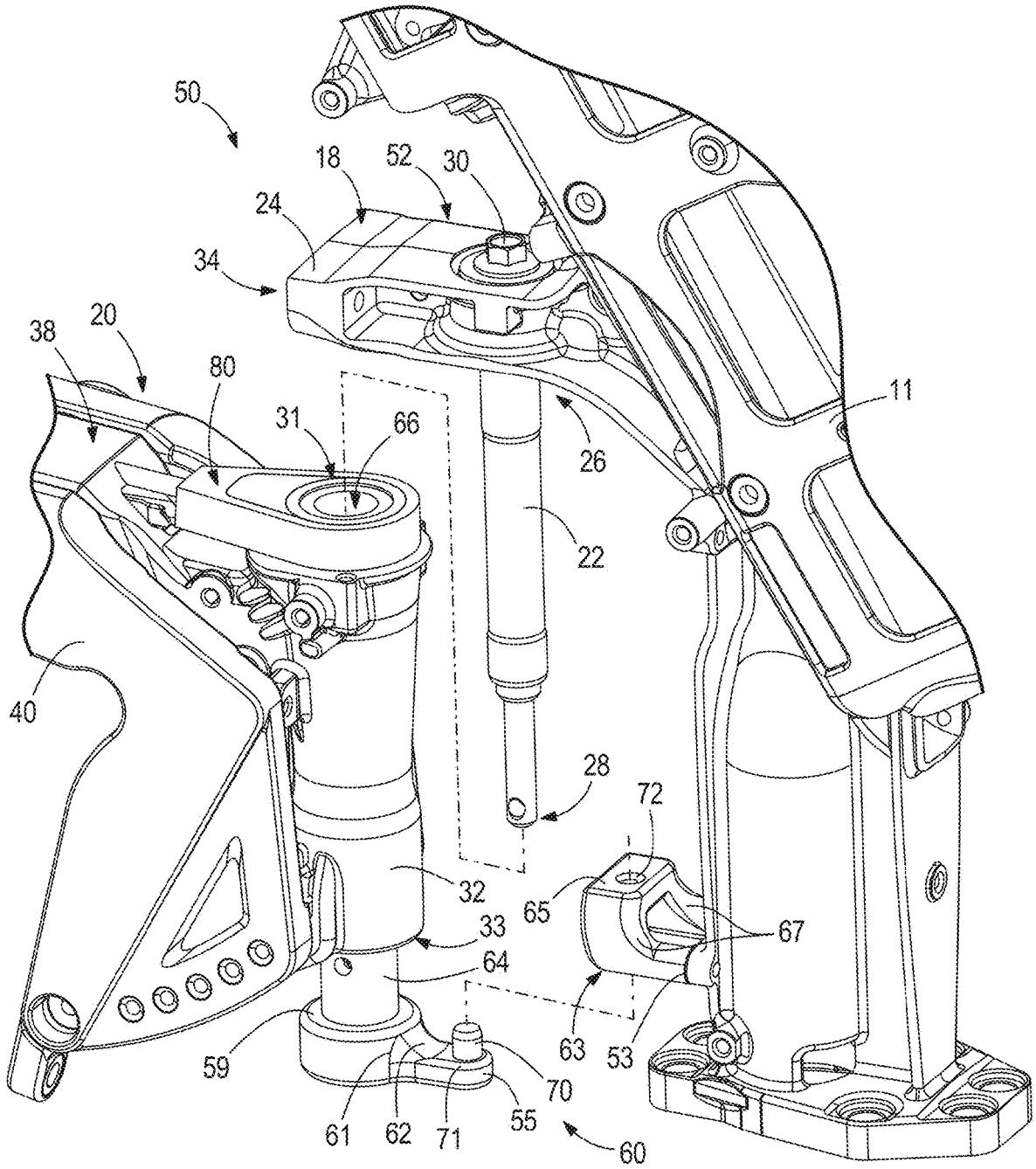
FIG. 3 is a perspective view of a first example of the assembly in a disassembled state.
Figure 4:
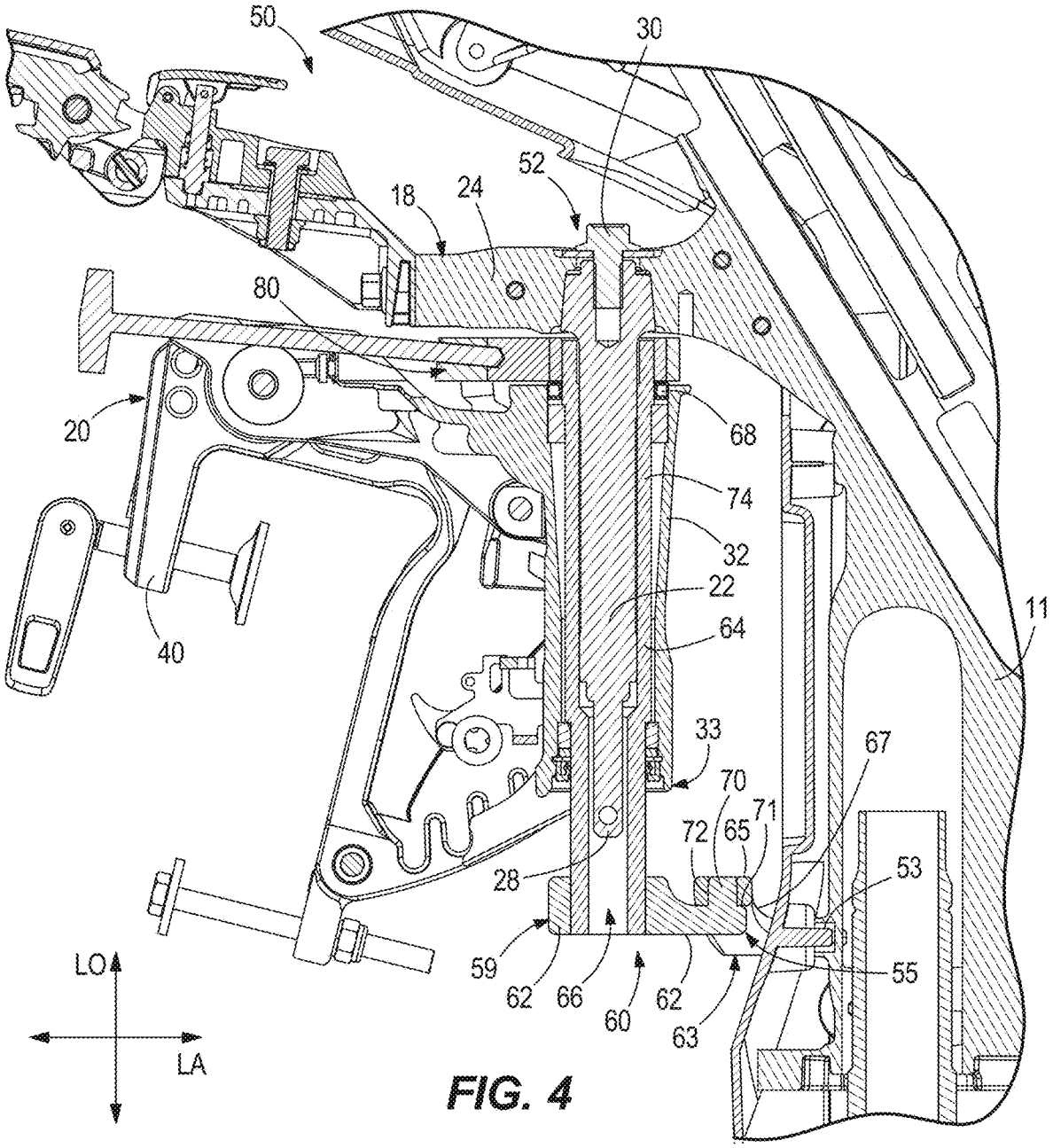
FIG. 4 is a sectional view of the first example of the assembly in an assembled state.

Referring to FIGS. 2 and 3, the outboard motor 10 is coupled to the marine vessel by a novel assembly 50 which generally includes a steering bracket 18 and a transom bracket 20. As shown in FIG. 3, the outboard motor 10 and assembly 50 extend in a longitudinal direction LO and in a lateral direction LA that is perpendicular to the longitudinal direction LO. The steering bracket 18 is fixed to the supporting frame 11 generally along the midsection of the outboard motor 10. The steering bracket 18 has a rigid steering arm 24 and a swivel tube 22 which extends transversely downwardly from the steering arm 24. The steering arm 24 has a first end which is fixed to or formed with the supporting frame 11, and an opposing second end 34. As shown in FIGS. 1 and 4, a tiller 36 is attached to the second end 34. For the purposes of the present disclosure, the type and configuration of the tiller 36 can be conventional and can vary from what is shown. In the illustrated example, the tiller 36 is like what is disclosed in the presently-incorporated U.S. Pat. No. 9,764,813. The swivel tube 22 has an upper end 26 and a lower end 28. The upper end 26 is fixed to the steering arm 24 by a fastener 30. As shown in FIGS. 2-4, the lower end 28 is seated in and steerable relative to a corresponding swivel cylinder 32 of the transom bracket 20 about a steering axis 100 (see FIG. 2).

Figure 5:
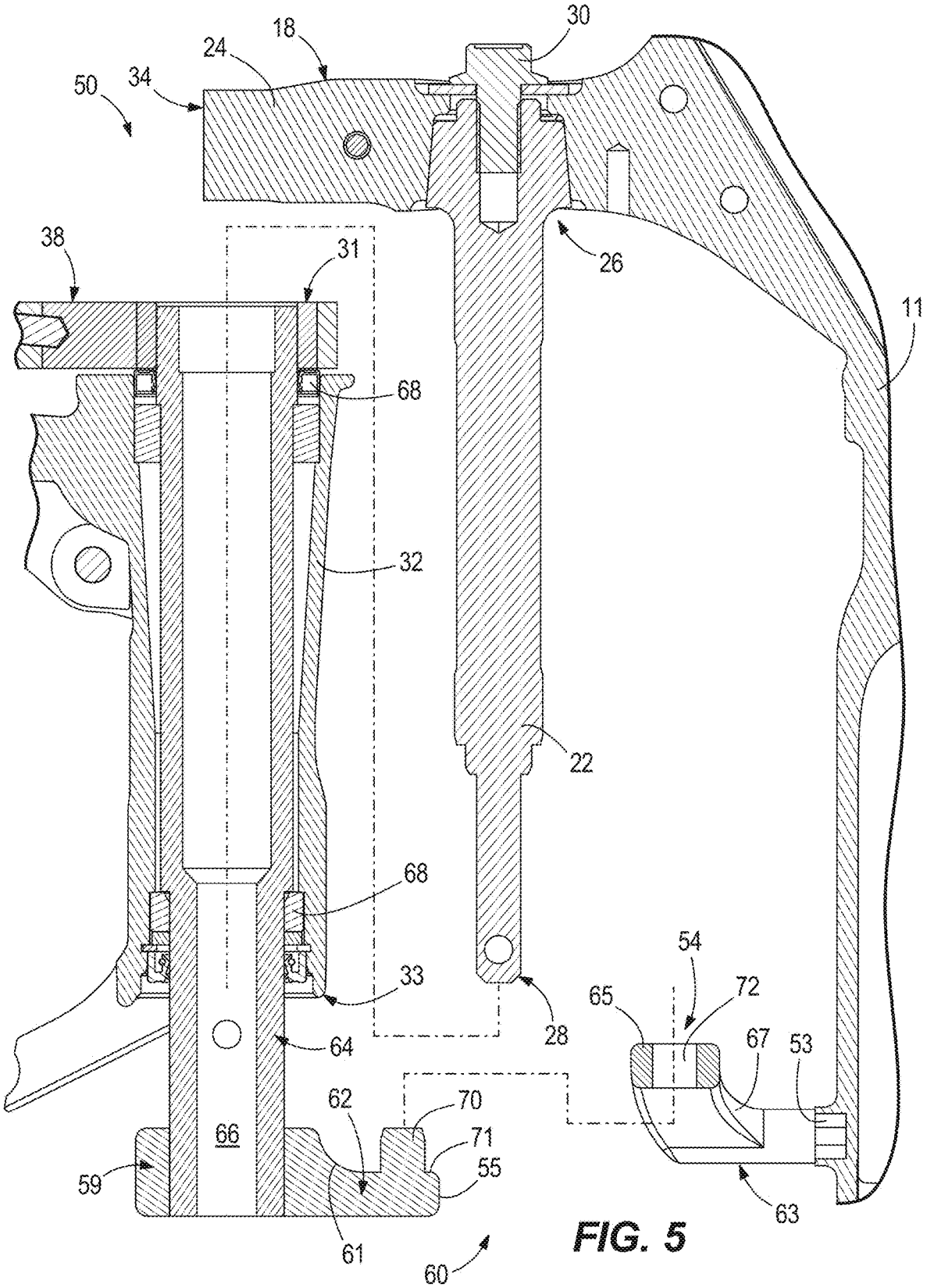
FIG. 5 is a sectional view of the first example of the assembly in the disassembled state.

The transom bracket 20 has a pair of clamp arms 40 which are fixed to the top of a not-shown transom of the marine vessel. A swivel bracket 38 is pivotably coupled to the upper end of the clamp arms 40 along a trim axis 200 which is perpendicular to the steering axis 100, so that the swivel bracket 38 is pivotable (i.e., trimmable) up and down about the trim axis 200. The swivel bracket 38 includes the swivel cylinder 32 nesting the swivel tube 22, as shown in FIGS. 3-5, in a manner which facilitates steering of the outboard motor 10 about the steering axis 100. The swivel cylinder 32 has an upper end 31, upon which the steering arm 24 rests, and a lower end 33. Manual steering of the tiller 36 rotates the swivel tube 22 in the swivel cylinder 32 about the steering axis 100, which thus rotates the outboard motor 10 about the steering axis 100 and affects the direction of the thrust generated by the propulsor 17 and the direction of travel of the marine vessel. Manual pivoting of the tiller 36 down and up about the trim axis 200 trims the outboard motor 10 up and down, respectively, relative to the transom.

The assembly 50 shown in the drawings is merely exemplary. For example, the assembly does not necessarily need to have a swivel bracket which is pivotable relative to a transom bracket. In other arrangements, the transom bracket and the swivel bracket are a monolithic component or made of several components which are not pivotable about a trim axis. Reference is made to the above-incorporated U.S. patents and patent applications, which illustrate various other suitable arrangements facilitating pivoting movement of a swivel bracket relative to a transom bracket.

In the illustrated example, the assembly 50 also has a co-pilot device 80, which permits the user to selectively restrain rotation of the swivel tube 22 within the swivel cylinder 32, for example to temporarily retain the tiller 36 and outboard motor 10 in a particular steering orientation, providing co-pilot functionality. Presently incorporated U.S. application Ser. No. 17/852,944 discloses the co-pilot device presently shown in the drawings, and thus for brevity it is not further described herein. For the purposes of the present disclosure the assembly 50 does not need to include a co-pilot device.

During research and development, the present inventors determined it would be advantageous to improve upon known transom bracket assemblies for supporting marine drives on a transom of a marine vessel, in particular by providing improved transom bracket assemblies which facilitate easy connection and disconnection of the marine drive, and improved transom bracket assemblies having multiple points of connection for the marine drive, having multiple shear points for load bearing and for separating of the marine drive from the marine vessel when in use the marine drive is impacted by a large force, for example during a logstrike event.

Referring to FIGS. 1-5, a first example of the assembly 50 according to the present disclosure has a yoke 60 which as further explained herein below advantageously couples the lower end 28 of the swivel tube 22 to the supporting frame 11. The yoke 60 generally comprises a yoke arm 62, a hitch bracket 63, and a receiver which in the illustrated example is a yoke cylinder 64 seated in the swivel cylinder 32. Referring to FIGS. 4 and 5, the yoke cylinder 64 has a body 74 which extends from the upper end 31 at the top of the swivel cylinder 32 to the lower end 33 which protrudes out of the bottom of the swivel cylinder 32. A passage 66 axially extends through the body 74. The upper end 31 of the yoke cylinder 64 is configured to receive the swivel tube 22 in the nested arrangement shown in FIG. 4. The lower end 33 of the body 74 protrudes out of the lower end of the swivel cylinder 32 and has a base 59. In non-limiting examples, the inner diameter of the yoke cylinder 64 is keyed to the outer diameter of the swivel tube 22, via for example axial grooves/splines and/or the like, to prevent relative rotation between the yoke cylinder 64 and the swivel tube 22. In other examples, the inner diameter of the yoke cylinder 64 and outer diameter of the swivel tube 22 have a non-circular outer profile when viewed in horizontal cross section, which thus prevents relative rotation between these components.

The lower end 33 of the yoke cylinder 64 is fixed to the yoke arm 62 at the base 59. The yoke arm 62 extends from the base 59 toward the outboard motor 10, i.e., transversely relative to the steering axis 100. The yoke arm 62 has an inner end 61 which is formed with or fixed to the base 59 and an outer end 55 having a pin 70, which extends upwardly from the base 59. The portions of the yoke arm 62 surrounding the pin 70 provide an annular lip 71 for supporting the hitch bracket 63 when the outboard motor 10 is installed, as shown and further described herein below. The hitch bracket 63 has a body 65 and a pair of L-shaped arms 67 which connect the body 65 to a mounting boss 53 on the lower leg of the supporting frame 11. A through-bore 72 in the body 65 is configured to receive the pin 70 of the yoke arm 62, as shown in FIGS. 2 and 4. The hitch bracket 63 can be formed with or fixed to the supporting frame 11 via welding, casting, and/or the like.

To install the outboard motor 10 onto the assembly 50, the user axially aligns the swivel tube 22 of the outboard motor 10 over the top of the swivel cylinder 32 of the assembly 50, as shown by dash-and-dot line in FIG. 5, and rotationally aligns the pin 70 of the yoke arm 62 with the bore 72 of the hitch bracket 63. The swivel tube 22 is then lowered into the swivel cylinder 32, which causes the bore 72 to be lowered onto the pin 70, as shown, until the bottom of the body 65 is supported on the annular lip 71 of the yoke arm 62, between the L-shaped arms 67. In this position, the L-shaped arms 67 are located on opposite sides of the yoke arm 62, preventing relative rotation between the yoke arm 62 and the hitch bracket 63.

In the illustrated example, the outboard motor 10 is operably coupled to the transom bracket 20 at a rigid, first joint 52 formed by the bolted connection between the upper end of the swivel tube 22 and the steering arm 24, and at a rigid, second joint 54 formed by male-female connection between the pin 70 and bore 72. In use, the assembly 50 is configured such that the yoke cylinder 64 is freely rotatable within the swivel cylinder 32, while the keyed connection rotationally locks the swivel tube 22 within the yoke cylinder 64. As such, steering of the outboard motor 10 via the tiller 36, relative to the steering axis 100, rotates the yoke cylinder 64 and the yoke arm 62 together with the swivel tube 22, relative to the swivel cylinder 32.

It will thus be understood by one having ordinary skill in the art that the assembly 50 is advantageously configured to distribute the shear forces encountered by the outboard motor 10 during impact, for example upon a logstrike event, across the first and second joints 52, 54 which are spaced apart from each other in both the radial and axial directions relative to the swivel tube 22. This improves load bearing and permits the assembly to be made up of relatively smaller and lighter weight components compared to the prior art having only one shear location. In the illustrated example, the first joint 52 is positioned at the upper end 31 of the swivel cylinder 32, where the steering arm 24 is bolted to the swivel tube 22 via the fastener 30. The second joint 54 is positioned below the first joint 52 at the outer end 55 of the yoke arm 62, where the pin 70 engages the bore 72 and the body 65 is seated on the annular lip 71. Improved load bearing is achieved by providing the two vertically and horizontally displaced shear locations which also extend generally parallel to one another. The first joint 52 provides a first shear location at which the outboard motor 10 will separate from the swivel cylinder 32 upon an impact load on the outboard motor 10. The second joint 54 also provides a second shear location at which the outboard motor 10 will separate from the swivel cylinder 32 upon the impact load.

When the outboard motor 10 is impacted by a sufficient force, for example during a logstrike event, the assembly 50 is advantageously configured such that the outboard motor 10 will separate from the transom bracket 20 at both the first joint 52 and the second joint 54.

Figure 6:
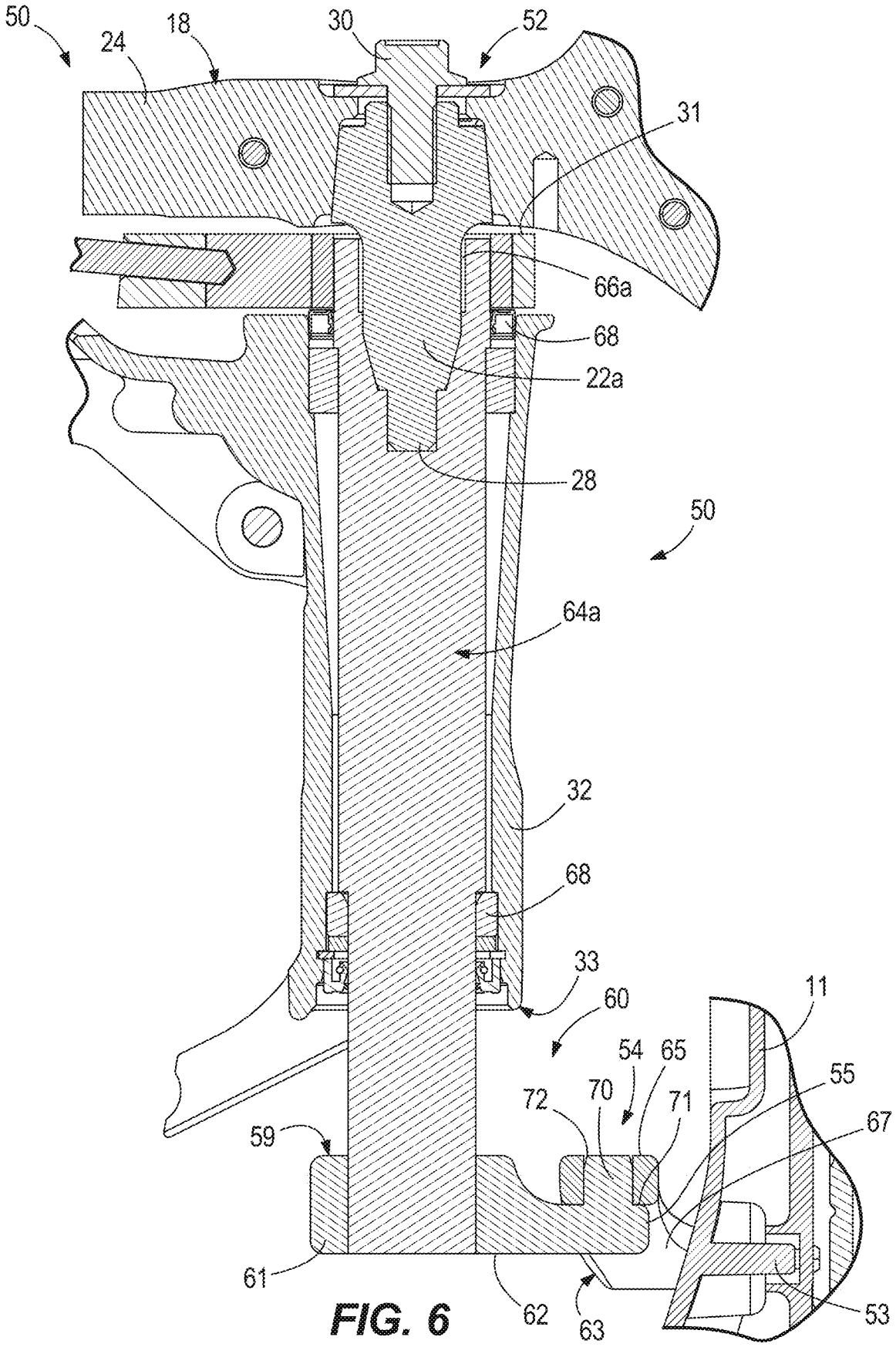
FIG. 6 is a sectional view of a second example of the assembly in an assembled state.

FIG. 6 depicts a second example in which, like the first example, has the transom bracket 20 and the steering bracket 18. However, compared to the first example, the second example has an axially shorter swivel tube **22*a* having less weight and thus providing a simpler nested connection. Installation of the outboard motor 10 into the assembly 50 is the same as the first example and the first joint 52 and the second joint 54 are positioned at the same locations as the first example. In use, steering of the outboard motor 10 via the steering arm 24 rotates the yoke cylinder 64 and the yoke arm 62 together with the swivel tube 22*a* relative to the steering axis 100. In the event of an impact load, the outboard motor 10 of the second example separates from the swivel cylinder 32 in the same way as in the first example, which is described above. It is possible to utilize the shorter swivel tube 22*a* having reduced weight because of the above-described improved distribution of the shear load across the noted points 52, 54. The improved load bearing capabilities provided by connection at first and second joints 52, 54** eliminates the need for an elongated swivel tube, as shown in the first example.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A transom bracket assembly for supporting a marine drive on a marine vessel, the marine drive extending in a longitudinal direction and in a lateral direction that is transverse to the longitudinal direction, the transom bracket assembly comprising:

a supporting frame of the marine drive;

a transom bracket having a swivel cylinder;

a steering arm laterally extending from the supporting frame;

a swivel tube longitudinally extending from the steering arm, the swivel tube having a first end coupled to the steering arm and a second end seated in the swivel cylinder so that steering of the steering arm relative to the transom bracket rotates the swivel tube in the swivel cylinder; and a yoke that couples the second end of the swivel tube to the supporting frame, wherein the swivel tube is coupled to the steering arm at a first joint providing a first lateral shear location at which the supporting frame will separate from the swivel cylinder upon an impact load on the marine drive, and wherein the yoke defines a second joint providing a second lateral shear location at which the supporting frame will separate from the swivel cylinder upon the impact load on the marine drive.

2. The transom bracket assembly according to claim 1, wherein the first joint comprises a longitudinally extending fastener.

3. The transom bracket assembly according to claim 1, wherein the second joint comprises a male-female connection configured so that insertion of the swivel tube into the swivel cylinder couples the swivel tube to the marine drive via engagement of the male-female connection.

4. The transom bracket assembly according to claim 1, wherein the second joint comprises a longitudinally extending pin and an aperture that receives the pin when the swivel tube is inserted into the swivel cylinder.

5. The transom bracket assembly according to claim 1, wherein the yoke is configured so that insertion of the swivel tube into the swivel cylinder couples the marine drive to the transom bracket via the yoke.

6. The transom bracket assembly according to claim 1, wherein the steering arm and the yoke are generally parallel and extend laterally relative to the steering arm.

7. The transom bracket assembly according to claim 1, wherein the steering arm is located longitudinally above the swivel cylinder and the yoke is located longitudinally below the swivel cylinder.

8. The transom bracket assembly according to claim 1, wherein the yoke comprises a yoke arm that laterally extends towards the supporting frame.

9. The transom bracket assembly according to claim 1, wherein the yoke comprises a receiver in and extending below the swivel cylinder and a yoke arm extending from the receiver below the swivel cylinder, the receiver being configured to engage with the swivel tube when the swivel tube is inserted in the swivel cylinder so that thereafter the receiver and yoke arm rotate with the swivel tube.

10. The transom bracket assembly according to claim 9, wherein the swivel tube is rotationally locked to the receiver when the swivel tube is inserted in the swivel cylinder.

11. The transom bracket assembly according to claim 9, wherein the receiver comprises a cylinder in which the swivel tube nests when the swivel tube is inserted into the swivel cylinder.

12. The transom bracket assembly according to claim 9, wherein the receiver comprises a yoke cylinder, and wherein the swivel tube is nested in the yoke cylinder, and further wherein the swivel tube and yoke cylinder are keyed together so that the swivel tube and the yoke cylinder rotate together.

13. A transom bracket assembly for supporting a marine drive on a marine vessel, the transom bracket assembly comprising:

a supporting frame of the marine drive;

a steering arm extending from the supporting frame;

a transom bracket having a swivel cylinder;

a swivel tube having a first end coupled to the steering arm and a second end seated in the swivel cylinder so that steering of the steering arm relative to the transom bracket rotates the swivel tube in the swivel cylinder; and a yoke that couples the second end of the swivel tube to the supporting frame, wherein the yoke is configured so that insertion of the swivel tube into the swivel cylinder couples the swivel cylinder to the supporting frame via the yoke.

14. The transom bracket assembly according to claim 13, wherein the swivel tube is coupled to the steering arm at a first joint defining a first lateral shear location at which the marine drive will separate from the swivel cylinder upon an impact load on the marine drive.

15. The transom bracket assembly according to claim 14, wherein the yoke defines a second joint defining a second lateral shear location at which the marine drive will separate from the swivel cylinder upon the impact load on the marine drive.

16. The transom bracket assembly according to claim 13, wherein the yoke comprises a receiver in the swivel cylinder and a yoke arm extending from the receiver, the receiver being configured to operably engage with the swivel tube when the swivel tube is inserted in the swivel cylinder so that the receiver and yoke arm rotate with the swivel tube.

17. The transom bracket assembly according to claim 16, wherein the yoke comprises a male-female connection device configured so that insertion of the swivel tube into the swivel cylinder couples the swivel tube to the marine drive.

18. The transom bracket assembly according to claim 17, wherein the male-female connection device comprises a pin and an aperture.

* * * * *